United States Patent [19]

Netta et al.

[11] 4,357,970

[45] Nov. 9, 1982

[54] TIE EJECTING APPARATUS IN A BUNDLING TIE APPLYING TOOL

[75] Inventors: Louis A. Netta, North Brunswick; Laszlo Hidassy, Jamesburg, both of N.J.

[73] Assignee: Thomas & Betts Corporation, Raritan, N.J.

[21] Appl. No.: 203,695

[22] Filed: Nov. 3, 1980

[51] Int. Cl.[3] ..... B21F 9/02

[52] U.S. Cl. ..... 140/123.6; 140/93.2

[58] Field of Search ..... 140/49, 52, 56, 57, 140/93 R, 93 A, 93.2, 123.6; 100/6, 33 PB

[56] References Cited

U.S. PATENT DOCUMENTS

| | | | |
|---|---|---|---|
| 3,391,440 | 7/1968 | Harms | 29/203 |
| 3,438,406 | 4/1969 | Rozmus | 140/93.2 |
| 3,515,178 | 6/1970 | Hidassy | 140/123.6 |
| 3,735,784 | 5/1973 | Obuch et al. | 140/93.2 |
| 3,746,055 | 7/1973 | Farkas et al. | 140/93.2 |
| 3,891,012 | 6/1975 | Bakermans | 140/93 A |
| 3,946,769 | 3/1976 | Caveney et al. | 140/93.2 |
| 4,047,545 | 9/1977 | Paradis | 140/123.6 |
| 4,093,005 | 6/1978 | Eberhardt et al. | 140/123.6 |
| 4,119,124 | 10/1978 | Collier et al. | 140/93.2 |
| 4,129,157 | 12/1978 | Sciolotto | 140/123.6 |

*Primary Examiner*—Lowell A. Larson

*Attorney, Agent, or Firm*—Robert M. Rodrick; Salvatore J. Abbruzzese; Jesse Woldman

[57] ABSTRACT

A tie scrap ejecting apparatus is provided in a bundling tie applying tool for positive controlled ejection of a portion of a bundling tie severed upon being suitably tensioned about a plurality of articles. The ejecting apparatus includes a plurality of tubes, interconnected for slidable, telescopic movement. The smallest of the tubes is coupled to a movable support that supports the tie severing means and is thereby movable therewith. The smallest tube has a passageway for close passage of a severed tie therethrough, the passageway communicating with the severing means. The largest tube is stationarily affixed to the housing, its opening communicating with a port of egress for discharging the severed tie portion. The other tubes are movable with respect to the largest tube, each of the movable tubes having an end surface that upon collapsing of the apparatus lies closely adjacent the port of egress for pushing a severed tie portion therethrough.

23 Claims, 5 Drawing Figures

TIE EJECTING APPARATUS IN A BUNDLING TIE APPLYING TOOL

FIELD OF THE INVENTION

This invention relates to a bundling tie applying tool and, more specifically to a tie ejecting apparatus in such a tool for controllably discharging severed excess bundling tie portions. The present invention is particularly, but not exclusively, useful in the type of tool disclosed in copending patent application, Ser. No. 230,687, filed concurrently herewith, entitled "Bundling Tie Applying Tool," and assigned to the same assignee as is the present invention.

BACKGROUND OF THE INVENTION

Tools for applying bundling ties about wires in harnesses or about other articles are generally known and may be manual, semi-automatic or automatic. Because of high production demands, the automatic tool has become popular. The automatic tool typically includes means for positioning a bundling tie about the wires, tensioning the ties and then severing the tie upon being suitably tensioned. After the ties are suitably severed upon being tensioned, the excess tie portions are discharged from the tool. While in some tools discharge is effected by simple release and gravitational discharge, other tools utilize ejecting means for controlling the discharge of the excess tie portions.

In the known ejecting mechanisms, controlled discharge is provided by contoured deflecting surfaces or spring biased guides for reducing the tendency of a severed strap to be propelled. In one tool utilizing a rotary driven wheel to tension the tie, the excess strap portion, upon being severed, is propelled out the top of the tool by the rotary driven member. In another tool utilizing a rotary driven member the tie, upon being severed, is ejected by the driving mechanism and guided by ejector plates to an opening in the bottom of the tool through which the scrap is discharged. In another tool arrangement, discharge of the severed tie portion is effected by the snapping action of a tie threading block under the influence of a compression spring to expel the excess tie portion through an aperture in the tool housing.

In discharging severed tie portions, one of the problems encountered, in particular in the automatic tool where a rapid succession of tie application is desired, is the assurance of positive ejection. Improperly ejected tie scraps can result in tool jamming and damage, leading to costly delays and repairs.

SUMMARY OF THE INVENTION

It is an object of the present invention to provide an improved tie ejecting apparatus in a bundling tie applying tool.

It is another object of the present invention to provide an ejecting apparatus for facilitating positive ejection of the tie scraps from a bundling tie applying tool.

In accordance with the invention, tie ejecting apparatus is provided in a bundling tie applying tool for installing an elongate bundling tie about a plurality of articles to be bundled. The tool is of the type having a housing, means for severing a portion of a tie positioned about the articles and a port of egress on the housing for the discharge of the severed tie portion. The ejecting apparatus comprises means within the housing defining a closed course extending from the severing means to the port of egress for receiving and containing therein a severed tie portion. Included is plunger means movable within the enclosed course to a position closely adjacent the port of egress for engaging and pushing therethrough a severed tie portion positioned in the enclosed course.

In the preferred form, the means defining the enclosed course includes a plurality of telescopically collapsible hollow tubular members that are movable from a first extended length to a collapsed shortened length. A tubular member at one end is stationarily affixed to the housing with its opening communicating with the port of egress. The other tubular members are slidably movable with respect to the fixed tubular member. A tubular member at the other end is coupled to a movable support that supports the severing means, such tubular member having a passageway communicating with the severing means. Each of the movable tubular members has an end surface movable within the enclosed course such that upon being collapsed, the end surface of each tubular member is positioned closely adjacent to the port of egress to engage and push a severed tie portion therethrough.

DESCRIPTION OF THE PREFERRED EMBODIMENTS

Figure 1:
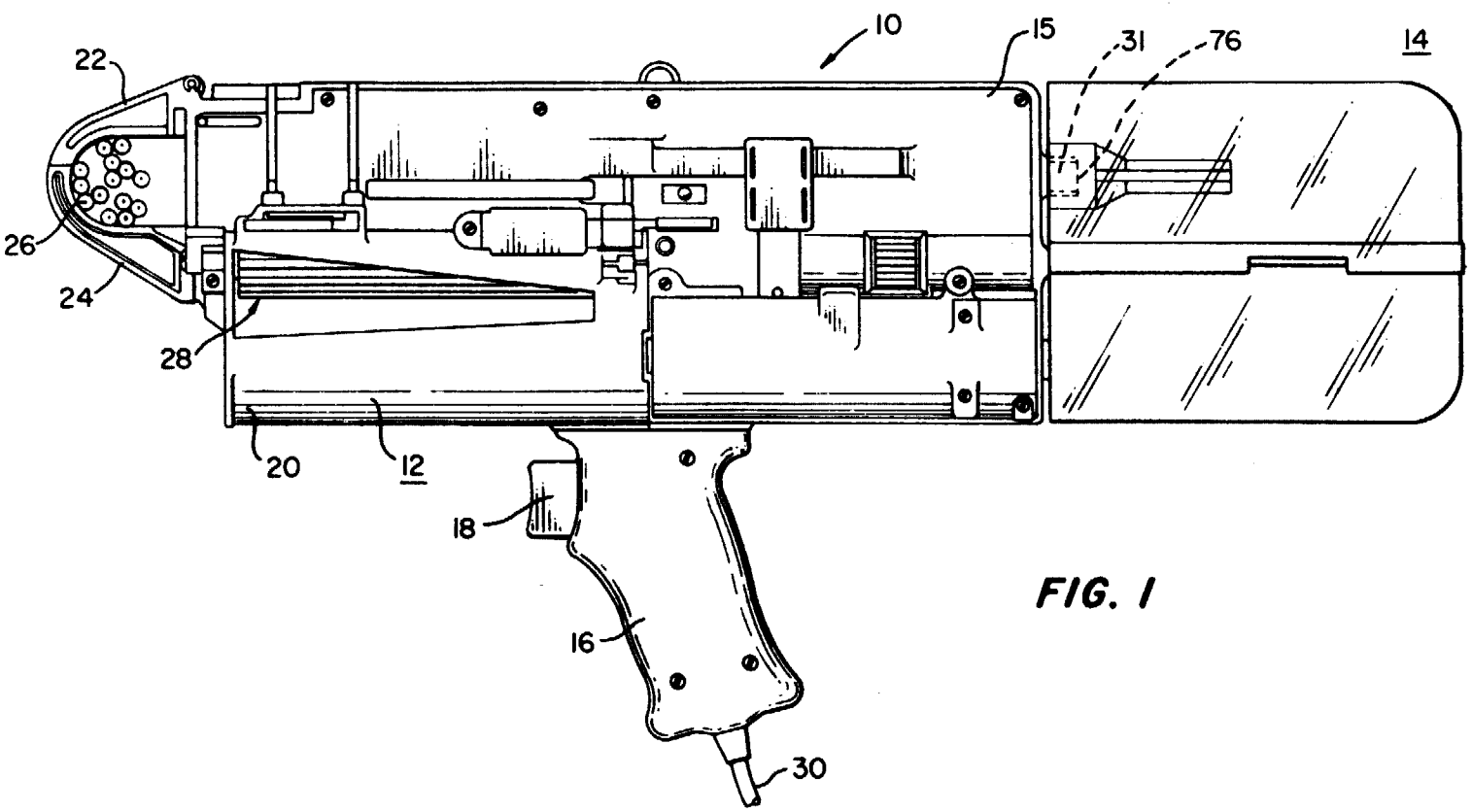
FIG. 1 is a side elevational view of a power-operated, automatic bundling tie applying tool embodying the present invention.

Referring to the drawing, there is shown in FIG. 1 an automatic bundling tie applying tool, generally indicated as numeral 10, incorporating features of the present invention. The tool 10 is preferably of the type as shown and described in copending patent application, U.S. Ser. No. 203,687, entitled "Bundling Tie Applying Tool," filed on even date herewith, and assigned to the same assignee as is the present invention. In brief, the tool 10 is an electrically powered tool capable of installing a bundling tie of the self-locking type having an apertured head portion and an elongate, flexible strap portion extending therefrom. The ties may be of the type shown and described by Noorily in U.S. Pat. No. 3,973,293, assigned to the same assignee as is the present invention. The tool 10 has means for receiving ties individually from a series of such bundling ties interconnected between adjacent head portions by a web. Means are included in the tool 10 for advancing the ties to a separating station whereat the web between each head portion is cut thereby providing separated, individual ties. The separated ties are further advanced to a feeding station whereat a reciprocating member feeds and positions an individual bundling tie in a closed loop about the articles to be bundled. Included are means for tensioning the tie about the articles and means for severing the tensioned tie, preferably at a predetermined tension.

Generally, the tool 10 comprises a housing 12, a scrap container assembly 14 suitably attached to the rearward housing end 15 and a handle 16 with a trigger 18 mounted therein. The scrap container 14 suitably collects severed excess tie portions upon being ejected through a discharge port 31 by the ejecting means of the present invention, as will be described. At the forward end 20 of the housing 12 where the ties are applied to a bundle of articles, there are a pair of hook members 22 and 24. The lower hook member 24 is stationary while the upper hook member 22 is movable with respect thereto. The movable upper hook 22 is movable to a position for receipt of a plurality of wires 26 to be bundled. Once the wires 26 have been received within the confines of the hooks 22 and 24, the upper hook is closed to facilitate looping of a cable bundling tie about the wires 26. The tool 10 includes a tie carrying mechanism 28 for supporting a plurality of ties thereon and subsequently advancing the ties to a position in preparation for looping about the wires 26.

As further shown in FIG. 1, extending from the bottom portion of the handle 16 is a suitable electric cord 30 for providing electric power to the tool 10. The cord 30 is connected to a suitable source (not shown) of electrical power. The source may be a power supply capable of converting conventional line 110 volt or 220 volt alternating current to direct current for operating an electric motor housed within the tool 10. Alternatively, the source may be a battery supply capable of providing requisite direct current to the tool 10.

Figure 2:
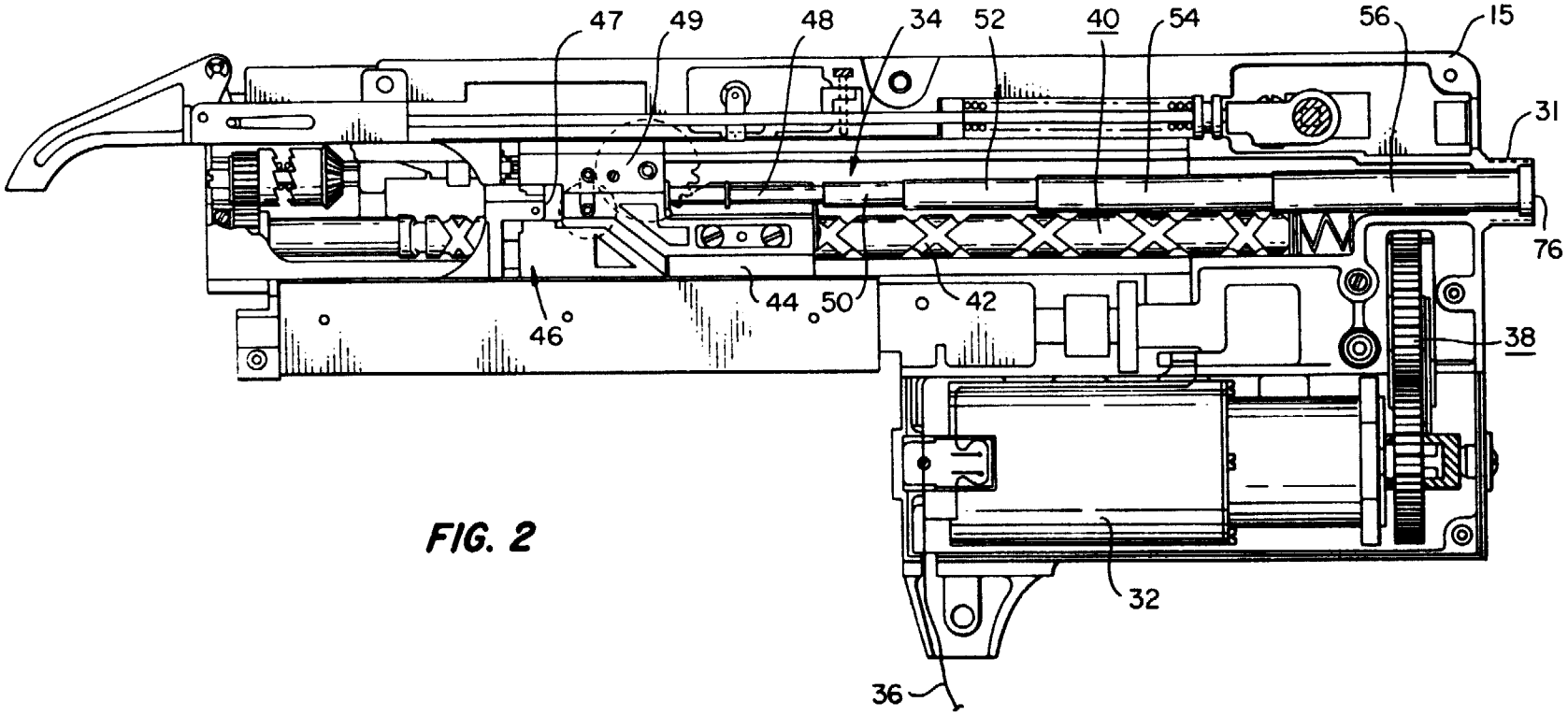
FIG. 2 is a side elevational view of the tool of FIG. 1 with the left side of the tool housing removed to show the present invention as assembled in the tool.

Turning now to FIG. 2, details of the tool drive mechanism for effecting movement of an ejector mechanism 34 are shown. A direct current motor 32 is suitably connected as by a line 36 to the power source supplied to the tool through cord 30 (FIG. 1). The motor 32 is suitably coupled by a gear train 38 to a drive shaft 40 suitably mounted in the housing 12 for rotation. The drive shaft 40 has a double helical groove 42 extending axially therealong on which a carriage 44 linearly reciprocates during shaft rotation. Suitably connected to the carriage 44 for reciprocating movement therewith is a tie feeding mechanism, generally designated as numeral 46. One function of the tie feeding mechanism 46 is to engage a bundling tie and feed such tie to the hooks 22 and 24 whereat they are looped about articles to be bundled. The tie feeding mechanism 46 also supports for movement therewith a tie severing mechanism 47 for severing the excess portion of the bundling tie upon being suitably tensioned about the wires 26 by a tie tension mechanism 49. The scrap ejector mechanism 34 is suitably coupled to the tie feeding mechanism 46 to facilitate operation of the ejector mechanism as will be described.

Figure 3:
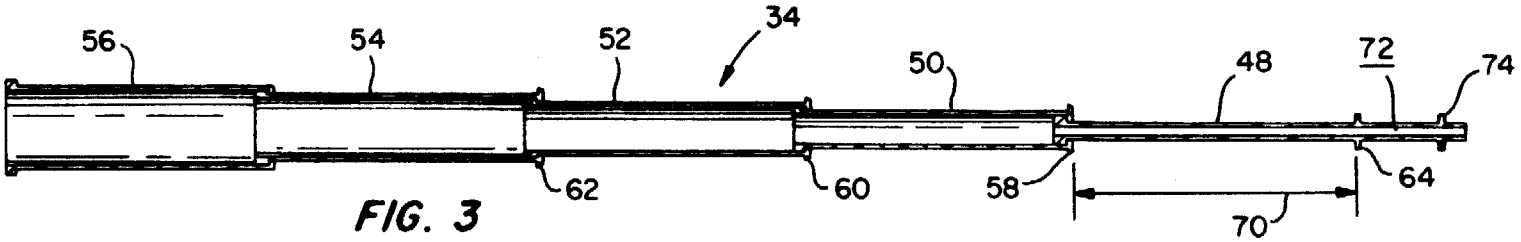
FIG. 3 is a side sectional view of the tie scrap ejector mechanism in accordance with a preferred embodiment of the invention.
Figure 5:
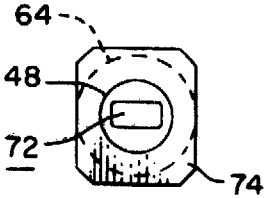
FIG. 5 is a front elevational view of the ejector mechanism of FIG. 3.
Figure 4:
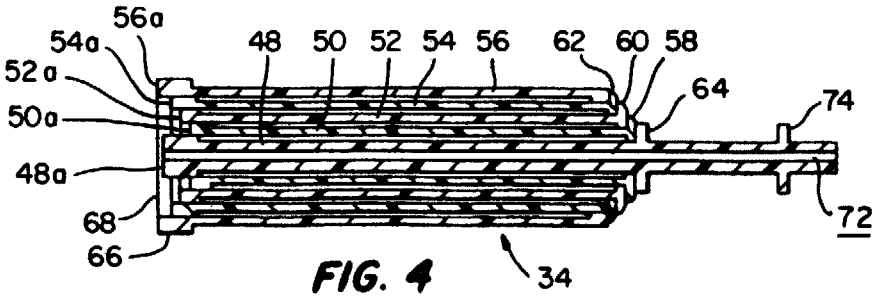
FIG. 4 is an enlarged, side sectional view of the ejector mechanism of FIG. 3 shown in a telescopically collapsed condition.

Referring to FIGS. 3, 4 and 5, the details of the scrap ejector mechanism 34, for positive, controlled ejection from the tool 10 of a severed tie portion may be appreciated. The ejector mechanism 34 comprises a plurality of elongage, hollow cylindrical tubes 48, 50, 52, 54 and 56, interlocked together for telescopic, collapsible movement. Such tubes define an enclosed path between the severing mechanism 47 in the movable tie feeding mechanism 46 and the discharge port 31. Although five tubes are shown in the preferred arrangement, it should be understood that any other number of tubes, with at least two, may be used. Each of the tubes from the tube 48 to the tube 56 has a successively increasing outer diameter. The outer diameter of each of the tubes, except the largest tube 56, is formed to have a close sliding fit with the inner diameter of the succeeding tube. Thus, tube 48 slides closely within tube 50, and tube 50 within tube 52 and so on.

Tubes 50, 52 and 54 have at the tube receiving ends radially projecting abutments 58, 60 and 62, respectively, serving as stops for the succeeding tubes thereon. Tube 48 has a spacer 64 serving as a stop for the tube 50 and as a means for pushing the tubes into a completely collapsed condition. The spacer 64 is positioned on the smallest tube 48 at a preselected axial distance 70 from the succeeding tube 50 to provide engagement therewith during reverse movement of the tube 48, as will be described, and thus provide pushing of the tubes into the completely collapsed condition. Upon reverse movement of the tube 48, the spacer 64 engages the tube 50, abutment 58 engages the tube 52, abutment 60 engages the tube 54 and abutment 62 engages the largest tube 56. A completely collapsed mechanism 34 is shown in FIG. 4. The tube lengths are formed such that the tube end surfaces 48*a*, 50*a*, 52*a*, 54*a* and 56*a* of the completely collapsed mechanism 34 at the discharge end 66 lie closely adjacent an end plane 68. As defined in this context, the term "closely adjacent to" includes the positions wherein, the end surfaces of the tubes at the mechanism end 66 are at, closely interiorly within the end plane 68 or closely exteriorly beyond the end plane 68. For example, in the preferred embodiment, the lengths of the tubes 50, 52, 54 and 56 are formed for manufacturing purposes to be approximately the same. The abutments 58, 60 and 62 are formed to have small axial extents, on the order of mils, so that when the tubes are collapsed, thee tube end surfaces at mechanism end 66 will be slightly staggered but, nevertheless, closely adjacent to the end plane 68 as shown in FIG. 4. It should be appreciated that the lengths of the tubes may be formed to compensate for the axial extent of the abutments, whereby all the tube end surfaces will lie in a substantially common plane at the plane 68 in the collapsed mechanism. Thus, other than a small opening 72 extending through the tube 48, the end surfaces of tubes in the collapsed condition at the end 66 define, with close fitting interfaces, a substantially solid cross-section thereat in a direction transverse the longitudinal direction of the ejecting mechanism 34.

As shown in FIG. 5, the opening 72, extending lengthwise throughout the tube 48, is preferably rectangular and adapted to closely receive axially therethrough the excess tie strap portion of rectangular cross-section that is severed in the tie feeding mechanism 46 illustrated in FIG. 2. The tube 48 is provided with a flange 74 for connecting the tube 48 to the tie feeding mechanism 46 such that the opening 72 is positioned in communication with the tie severing mechanism 47 to receive the excess tie strap upon being severed. The tie tensioning mechanism 49 propels a severed tie portion from the severing mechanism 47 into the opening 72 in the tube 48. As shown in FIG. 2, the ejector mechanism 34 is mounted in the tool with the largest tube 56 suitably stationarily affixed to the housing 12 and opening into an aperture 76 of the housing discharge port 31 at the tool rearward end 15 for egress of the severed tie portions. The smallest tube 48, being connected to the feeding mechanism 46 is movable therewith. Upon linear reverse movement of the tie feeding mechanism 46 during the tool operation, the smallest tube 48 is slid telescopically into the succeeding tube 50 until the spacer 64 engages the tube 50. At such engagement the tube 50 is slidably pushed by the spacer 64 into the next succeeding tube 52 until the abutment 58 on the tube 50 engages the tube 52. The tubes are telescopically collapsed in this fashion until the feeding mechanism 46 reverses direction along the rotating shaft 40. At the point where the tie feeding mechanism 46 has reached the end of its rearward stroke, the ejector mechanism 34 is in its completely collapsed condition as described heeinabove. Upon linear forward movement of the tie feeding mechanism 46, the tubes are slid telescopically to their full extension at the forward end of the stroke of the tie feeding mechanism 46.

In operation, a tie strap is severed while the feeding mechanism 46 is temporarily stationary at the forward end 20 of the housing and the ejector mechanism 34 is thereby extended. Due to the high velocity of the tie tensioning mechanism 49, as the strap is severed it is thrust into the opening 72 and therethrough where it may or may not be propelled through the port opening 76. Should the severed excess strap portion be contained within one of the tubes, having exited the opening 72, the strap portion will be pushed out the port opening 76 by the end surfaces of the collapsing tubes during reverse movement, which effectively form the nearly solid wall when completely collapsed as described herein. Should the strap portion fail to exit the opening 72, upon severing of the subsequent tie strap, the subsequent scrap portion will push the first scrap portion out the opening 72, as the rectangular opening is restricted to axially receive and contain only one tie strap at a time.

Having described the ejector mechanism 34 of the present invention in the preferred embodiment of a telescopically collapsible tubular arrangement, it should be appreciated that other variations are contemplated within the scope of the invention for controllably discharging severed tie portions. For example, a collapsible bellows-type structure may be used to provide an enclosed course with a pushing member or plunger being movable therewithin. Such a plunger may have a surface movable to the port of egress of the housing as at the opening 76 so as to engage and push a portion of the severed tie therethrough.

Although the present invention is described herein in the context of an automatic power-operated bundling tie applying tool capable of receiving a series of webbed ties and cutting the webs therein, it should be appreciated that the contemplated scope of the invention is not so limited. For example, the invention may be used in tools for applying bundling ties wherein separate ties are supplied individually to the tool from a cartridge, hose or other loading device. Moreover, the tool may also be semi-automatically operable or manual.

Various other changes to the foregoing, specifically disclosed embodiments and practices will be evident to those skilled in the art. Accordingly, the foregoing preferred embodiments are intended in an illustrative and not in a limiting sense. The true spirit and scope of the invention are set forth in the following claims.

What is claimed is:

1. In a bundling tie applying tool for installing an elongate bundling tie about a plurality of articles to be bundled, said tool being of the type having a housing, means for severing a portion of said tie positioned about said articles and a port of egress on said housing for the discharge of said severed tie portion, tie ejecting apparatus comprising:

means within said housing defining an enclosed course extending from said severing means to said port of egress for receiving and containing therein a severed tie portion; and plunger means movable within said enclosed course to a position closely adjacent said port of egress for engaging and pushing therethrough a severed tie portion positioned in said enclosed course.

2. Ejecting apparatus according to claim 1, further including means for introducing said severed tie portion into said enclosed course.

3. Ejecting apparatus according to claim 2, wherein said introducing means includes a passageway in said plunger means for passage therethrough of a severed tie portion from said severing means to said enclosed course.

4. Ejecting apparatus according to claim 3, wherein said passageway is of dimension to closely pass said severed tie portion.

5. Ejecting apparatus according to claim 4, wherein said passageway is rectangular in cross-section.

6. Ejecting apparatus according to claim 1, wherein said housing is elongate and said enclosed path extends longitudinally thereof and wherein said plunger means has a surface extending in a direction transverse the longitudinal direction.

7. Ejecting apparatus according to claim 6, wherein said means defining an enclosed course comprises a hollow tubular member.

8. Ejecting apparatus according to claim 7, wherein said plunger means comprises an elongate tube slidable within said hollow tubular member, said elongate tube having an aperture for passage of a severed tie portion therethrough from said severing means to the interior of said hollow tubular member.

9. Ejecting apparatus according to claim 8, wherein a peripheral portion of said tube has a close sliding fit with an inner portion of said hollow tubular member.

10. Ejecting apparatus according to claim 7, wherein said plunger means comprises a plurality of hollow elongate tubes interconnected together and telescopically slidable longitudinally within said hollow tubular member, each of said tubes having a surface extending in a direction transverse the longitudinal direction, each of said surfaces being slidable to a position adjacent said port of egress.

11. Ejecting apparatus according to claim 10, further including means for pushing said tubes into a completely collapsed condition wherein the transverse surfaces of each of said tubes lie adjacent said port of egress.

12. Ejecting apparatus according to claim 11, wherein said pushing means comprises a stop member on one of said tubes.

13. Ejecting apparatus according to claim 11, wherein said tubes are generally cylindrical and are of successively increasing diameter and dimensioned for close sliding fit between such tubes and between the largest of said tubes and said hollow member, an inner portion of said smallest tube defining a passageway closely configured to the cross-section of said bundling tie for close passage therethrough of a severed tie portion from said severing means.

14. Ejecting apparatus according to claim 13, wherein said stop member is disposed on the smallest of such telescopically slidable tubes.

15. In a bundling tie applying tool for installing an elongate bundling tie about a plurality of articles to be bundled, said tool being of the type having a housing, means for severing a portion of said tie positioned about said articles and a port of egress on said housing for the discharge of said severed tie portion, ejecting means comprising:

means defining an enclosed course extending from said severing means to said port of egress for receiving and containing therein a severed tie portion, an extent of said enclosed course being collapsible from a first extended length to a second shortened length;

a pushing member extending within said enclosed course and movable relative thereto and having an opening for passage of a severed tie portion from said severing means to said enclosed course, said pushing means having a tie pushing surface movable to lie within said enclosed course at a location spaced from said port of egress at said first extended length, and to lie closely adjacent said port of egress at said second shortened length of said collapsible portion.

16. Ejecting apparatus according to claim 15 wherein said opening is of dimension for closely passing said severed tie portion.

17. In a bundling tie applying tool for installing an elongate bundling tie about a plurality of articles to be bundled, said tool being of the type having a housing, means for severing a portion of said tie positioned about said articles, a movable support supporting said severing means and a port of egress on said housing for the discharge of said severed tie portion, tie ejecting apparatus comprising:

a plurality of telescopically slidable elongate hollow members defining a collapsible portion of an enclosed course extending from said severing means to said port of egress for receiving and containing therein a severed tie portion;

a first member of said plurality of members having an opening communicating with said port of egress and being stationarily affixed to said housing, the other members being slidably movable with respect thereto;

a second member of said plurality of members having a passageway extending longitudinally therethrough for close passage of a severed tie portion and being coupled to said movable support, said passageway being in communication with said severing means, said telescopically sliding members, in response to the movement of said support, moving slidably from a first extended length to a second collapsed length, each of said movable members having an end surface movable within said enclosed course, each end surface being positioned at said extended length to lie within said enclosed course longitudinally spaced from said port of egress and at said collapsed length to lie closely adjacent said port of egress.

18. Ejecting apparatus according to claim 17, further including means responsive to the movement of said movable support for telescopically sliding said members to said second collapsed length whereby the end surfaces of such members lie closely adjacent said port of egress.

19. Ejecting apparatus according to claim 18, wherein said sliding means comprises a pushing element disposed on said first member.

20. Ejecting apparatus according to claim 17, wherein said elongate hollow members comprise a plurality of generally cylindrical tubes of successively increasing diameter and interconnected together, each of said tubes being dimensioned for a close sliding fit with a preceding tube therein.

21. Ejecting apparatus according to claim 20, wherein the smallest of said tubes is coupled to said support and the largest stationarily affixed to said housing.

22. Ejecting apparatus according to claim 21, wherein each of said tubes has a length whereby the end surfaces on each tube are positioned longitudinally successively within said enclosed course at the first extended length of said plurality of tubes.

23. Ejecting apparatus according to claim 17, wherein said passageway is substantially rectangular in cross-section.

* * * * *